United States Patent [19]

Kauwenberg

[11] Patent Number: 4,937,491

[45] Date of Patent: Jun. 26, 1990

[54] DISPLAY TUBE HAVING A POST-DEFLECTION STRUCTURE AND METHOD OF MANUFACTURING SAID STRUCTURE

[75] Inventor: Werner D. P. Kauwenberg, Eindhoven, Netherlands

[73] Assignee: U. S. Philips Corporation, New York, N.Y.

[21] Appl. No.: 243,366

[22] Filed: Sep. 12, 1988

[30] Foreign Application Priority Data

Sep. 14, 1987 [NL] Netherlands ..... 8702179

[51] Int. Cl.[5] ..... H01J 29/80

[52] U.S. Cl. ..... 313/422; 313/429; 445/47; 445/49

[58] Field of Search ..... 313/422, 458, 460, 421, 313/429, 105 CM, 103 CM; 445/36, 47, 49

[56] References Cited

U.S. PATENT DOCUMENTS 4,560,898 12/1985 Knapp et al. ..... 313/105 CM

*Primary Examiner*—Palmer C. DeMeo
*Assistant Examiner*—Michael Horabik
*Attorney, Agent, or Firm*—John C. Fox

[57] ABSTRACT

For fine-(for example post-)deflection of electron beams is a display tube, particularly of the flat, thin type, electrically insulated deflector plate portions are placed on either side of each beam prior to its reaching the phosphor screen. By choosing a special mask aperture geometry, a deflector is produced after a plate portion is bent out of the mask plane. By combining two masks (plates) with bent plate portions, an electrode structure is obtained having two separate flat deflector aperture electrode pairs per electron beam.

4 Claims, 3 Drawing Sheets

DISPLAY TUBE HAVING A POST-DEFLECTION STRUCTURE AND METHOD OF MANUFACTURING SAID STRUCTURE

BACKGROUND OF THE INVENTION

The invention relates to a picture display device comprising a closed envelope having substantially parallel front and rear walls, a layer of luminescent material on the inner surface of the front wall, electron-emissive means for generating at least one electron beam and a selection electrode system for causing the or each electron beam to be substantially perpendicularly incident on the layer of luminescent material so that the or each beam scans at least a part of the layer of luminescent material for building up a picture, and a fine-deflection structure comprising individual electron beam channels with each of which a first and a second deflector electrode is associated, which deflector electrodes can be energized to deflect an electron beam from the electron beam channel and which can be suitably controlled so that the electron beam can be accurately directed onto a desired surface element of the layer of luminescent material.

As compared with the conventional cathode ray tube a construction of the type described above has considerable advantages because shallow, flat television display devices can be realized by means of this construction. Points of consideration are, among others, obtaining a uniform brightness and resolving power throughout the picture surface independently of the driven pixel and the possibility of colour selection in colour display devices or the possibility of correcting the electron beams in high-resolution monochrome display devices.

A device of the type described in the opening paragraph is known, for example from the published British Patent Application No. 2,124,017. This Application relates to a device in which the luminescent screen is scanned by means of one electron beam which is produced by one cathode. Other shallow, flat display devices operate with, for example line cathodes producing a ribbon of electrons or with a large number of aligned cathodes producing a plurality of parallel electron beams.

The display tubes for shallow, flat display devices hitherto proposed often use a very fine electrode structure to obtain a limited horizontal (post)-deflection of electron beams (for example for creating colour, and/or for correcting certain types of alignment errors). The said fine-deflection structure comprises strip-shaped electrodes on either side of each beam so that a limited deflection of the beam is obtained by way of potential differences.

In addition to the use of metallized glass or ceramic material structures, research is particularly being done in the field of metal deflector electrode structures.

The following requirements are imposed on these fine-deflection electrode pairs: the electrodes must be mutually insulated, the electrode pairs must be electrically coupled so that the pairs can be switched simultaneously, the electrode structure must have a high accuracy to ensure uniform scanning and to provide the possibility of combination with the phosphor pattern on the screen and with mask structures in the interior.

In the known embodiments, research has been done in long electrodes which extend throughout the height of the display window and are thus strip-shaped. Problems in this field are:

handling, positioning, securing and keeping the strips in one plane, the sensitivity to vibrations of a strip structure, the mutual insulation of the strips and the combined coupling of the pairs, designing the strips while taking the etching geometry, plate thickness, and the formation of burrs into account, separating the strips if a temporary connection between the strips for the purpose of improved handling is allowed.

SUMMARY OF THE INVENTION

The invention has for its object to provide a picture display device in which these problems do not occur or occur to a considerably smaller extent.

To this end the picture display device of the type described in the opening paragraph is characterized in that small, flat deflector electrode plate portions or limbs on either side of each electron beam channel are used for the fine-deflection structure instead of long strips throughout the height. This provides the possibility of bending these limbs from pre-etched plates. Accordingly, two facing sides of each individual electron beam channel are each provided with a pair of mutually electrically isolated limbs, each limb bent out of the plane of one of two facing metal plates and constituting deflector electrodes. The invention therefore provides a solution to the problems of:

handling, etc. because use is made of the stability of plates;

great accuracy imposed on known etching techniques;

uniform design in which etching geometry, plate thickness etc. are less influential.

A preferred embodiment of the picture display device according to the invention is characterized in that the limbs between the electron beam channels are mechanically coupled to form electrically insulated pairs.

A stable construction can be obtained by means of this mechanical coupling.

The invention also relates to a method of manufacturing a fine-deflection structure with a plurality of electron beam channels having pairs of electrically isolated electrodes on either side. This method is characterized: in that a plurality of U-shaped openings is provided in each of a pair of metal plates, which openings each define a deflector electrode limb; in that the deflector electrode limbs in each plate are bent out of the planes of the plates; and in that the plates are positioned opposite each other with their deflector electrode limbs facing each other and being aligned with respect to each other.

A preferred embodiment of the method according to the invention is characterized in that a plurality of U-shaped openings is provided in each pair of metal plates, which openings each bound a deflector electrode limb on 3 sides; in that, after the plates have been provided with openings, an electrically insulating bonding agent is provided on the deflector electrode limbs of at least one plate; in that the plates are positioned back-to-back opposite each other in such a manner that the deflector electrode limbs of the one plate are aligned with the deflector electrode limbs of the other plate; in that the plates are secured together by means of said bonding agent; and in that the plates are subsequently moved away from each other and are simultaneously offset with respect to each other in a direction transverse to the bending lines of the deflector electrode limbs so that the deflector electrode limbs are bent pairwise out of the planes of the plates.

This method makes it surprisingly simple to bend the deflection electrode limbs, to align them with respect to each other and to couple them mechanically.

BRIEF DESCRIPTION OF THE DRAWINGS

The invention will now be described in greater detail by way of example with reference to the accompanying drawings in which.

The drawings are diagrammatic and not to scale; corresponding components are generally denoted by the same reference numerals.

DESCRIPTION OF THE PREFERRED EMBODIMENTS

Figure 1:
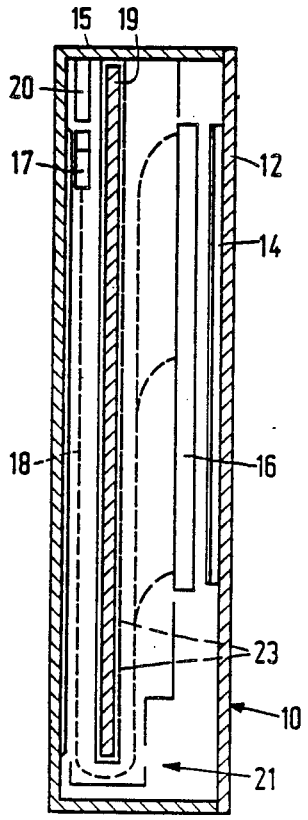
FIG.1 PRIOR ART
FIG. 1 is a diagrammatic cross-section of one embodiment of a display device of the prior art.

In FIG. 1 a device of the flat display tube type 10 comprises a rectangular envelope 15 having a substantially flat front plate 12. A phosphor screen 14 comprising a repeating pattern of groups of red (R), green (G) and blue (B) vertically extending phosphor lines is provided on the inner surface of the front plate 12. A channel plate electron multiplier 16 is spaced from the front plate 12 and positioned parallel thereto. A single beam electron gun 20 is accommodated in the rear part of the envelope and directs a low-energy electron beam 18 downwards in a direction parallel to the front plate 12 and to the rear wall 11 of the envelope 15. The beam is deflected by means of an electrostatic deflection unit 17 which is positioned proximate the gun 20 in a plane parallel to the front plate 12 in order to realize line scanning. The (line scanning) beam 18 is deflected through 180° by a folding lens 21 on the lower side of the envelope so that it extends in the opposite direction on the other side of a partition 19. The partition 19 supports a plurality of selectively energizable electrode strips 23 which are separated from one another in the vertical direction and extend in the horizontal direction. The electrode strips 23 are used for field scanning of the electron beam 18 across the entrance face of the channel plate electron multiplier 16. After having undergone electron multiplication in the multiplier 16, the beam is accelerated towards the phosphor screen 14 by means of an aluminium backing electrode 13 on the screen. The colour display tube of FIG. 1 is similar in many respects to the display tube described in the published British Patent Application 2,101,396 and reference is made to this publication for further details of the tube and its construction. However, the tube described in the said publication is monochrome and has a phosphor screen luminescing in one colour.

Figure 2:
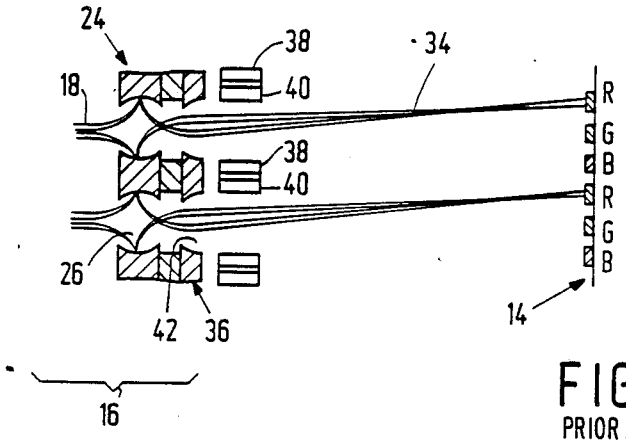
FIG.2 PRIOR ART
FIG. 2 is a diagrammatic cross-section of a part of the electron beam channel structure with fine-deflection electrodes and of the luminescent screen of the device of FIG. 1.

The channel plate electron multiplier 16 is of the laminated dynode type. The construction of this type is multiplier is described in British Patent Specifications 1,434,053 and 2,023,332. In this construction the electron multiplier 16 comprises a plurality of apertured dynodes 24, a portion of the last of which is shown in FIG. 2. The (barrel-shaped) apertures 26 in successive dynodes are aligned to form electron beam channels. During operation an electron beam entering a channel undergoes current multiplication by secondary emission when it passes from one dynode to the other, each of which is typically 300 V more positive than the previous one. An extractor electrode 36 having apertures 42 aligned with the channels of the multiplier is arranged at the end of the multiplier. The electrode 36 comprises half a dynode in this case. A positive voltage, typically +100 V with respect to that of the last dynode, is applied to the extractor electrode 36 not only to extract the electron beam 34 from the multiplier but also to focus it. In the arrangement of groups of red (R), green (G) and blue (B) phosphors shown in FIG. 2, a current-multiplied electron beam 34 which is not post-deflected will impinge on the green phosphor (G). In order to impinge on the red (R) and the blue (B) phosphor, the electron beam 34 must be deflected to the left and to the right, respectively (that is to say upwards and downwards, respectively in FIG. 2).

This deflection is realized by means of pairs of fine-deflection electrodes 38, 40 one of which pairs is positioned on either side of each aperture 42 of the extractor electrode 36. The electrodes 38 are electrically connected, as are the electrodes 40. As described in the published British Patent Application No. 2,124,017, the pairs of fine-deflection electrodes may alternatively be energized in such a manner that certain types of alignment errors are eliminated.

In order to deflect the electron beam 34 during operation, it is necessary to apply a potential difference between the electrodes 38, 40. For example, in a situation in which the extractor electrode 36 conveys a voltage of +100 V with respect to the last dynode and in which the screen 14 conveys a voltge of +7 to +10 kV, an average voltage of 250 V is applied to both electrodes 38, 40 for a beam 34 which is not to be deflected, and a potential difference of 100 V is applied between the electrodes 38, 40 for a beam to be deflected in the one or the other direction. For deflection towards the red phosphor (R) the electrode 40 conveys, for example +300 V and the electrode 38 conveys +200 V, whereas for deflection towards the blue phosphor (B) the voltages are reversed.

According to the invention, the fine-deflection electrodes 38, 40 are not formed as long, uninterrupted strips, as in the prior art, but as limbs bent out of the planes of two metal plates on either side of each end of an electron beam channel.

To realize this the starting material is a flat plate 43 which can be compared with the starting material for a shadow mask. This plate is provided with holes 44 (by means of etching or laser cutting) having such a shape that each hole 44 partly bounds a plate portion 38 (a "limb"). See FIGS. 3A (perspective view of the plate), FIG. 3B (plan view of the plate) and FIG. 3C (cross-sectional view taken on the line III C—C in FIG. 3B). The holes 44 are so designed that the plate portions or limbs 38 can easily be bent from the plate surface. The bending line will be in its correct position, which is ensured by partially etching away parts of the holes as can be seen in FIG. 5, or by the specific design (FIG. 4), or by both. The plate portions or limbs 38 may be bent mechanically by means of pins, or alternatively by exerting pressure on them by means of air or a liquid.

Figure 4A:
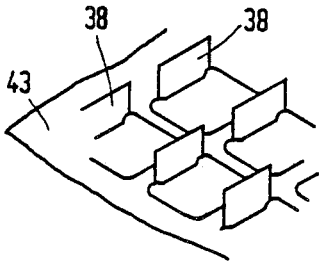
FIGS. 4A, 4B and 4C are a perspective elevational view, a plan view and a cross-section, respectively, of a part of a fine-deflection structure according to the invention during a further manufacturing step.
Figure 4B:
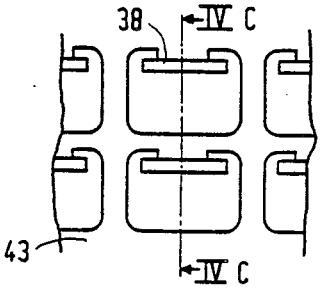
Figure 4C:
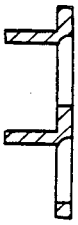
Figure 5:
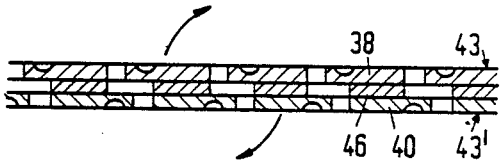
FIG. 5 is a cross-section of an assembly of two structures of the type shown in FIGS. 3A, 3B and 3C.

FIG. 4A is a perspective elevational view of the plate 43 after the plate portions or limbs 38 have been bent. FIG. 4B is a plan view of the same situation and FIG. 4C is a cross-sectional view taken on the line IV C—C in FIG. 4B.

Figure 3A:
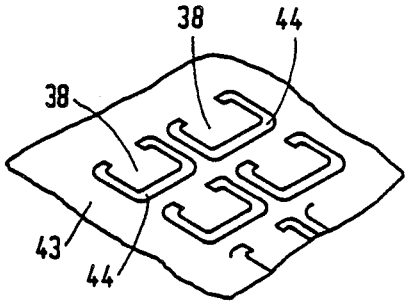
FIGS. 3A, 3B and 3C are a perspective elevational view, a plan view and a cross-section, respectively, of a part of a fine-deflection structure according to the invention during a manufacturing step.
Figure 3B:
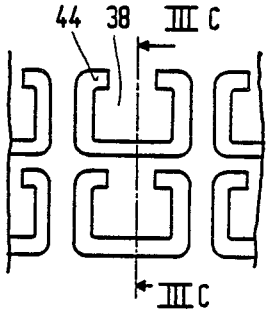
Figure 3C:
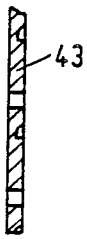

The desired fine-deflection structure is realized by using two plates having etched-out holes, for example by combining the plate 43 of FIG. 3A and a plate 43' identical thereto, with the bent deflector plate portions or limbs being correctly aligned with respect to each other, to a stable assembly. Bending the plate portions or limbs as well as the combination to a stable assembly can be elegantly and efficiently performed in the following manner within the scope of the invention. After the etching process the plates 43 and 43' are secured back-to-back by means of an electrically insulating bonding agent 46 connecting the plate portions or limbs 38 and 40 together. See FIG. 5. By moving the plates 43 and 43' thus secured together away from each other and by simultaneously offsetting them with respect to each other (these movements are illustrated by means of arrows in FIG. 5) the deflector plate portions or limbs 38, 40 pairwise assume a position in the same plane transversely to the plates. See FIG. 6. This operation may be assisted by using pins, liquid or air pressure in order to press the deflector plate portions from the plate planes.

Figure 6:
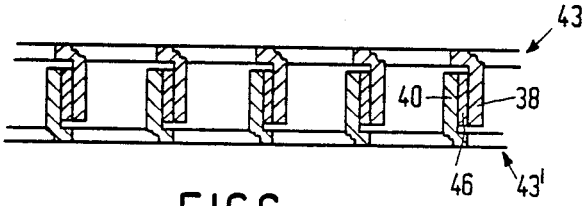
FIG. 6 is a cross-section of the assembly of FIG. 5 during a subsequent manufacturing step.
Figure 7:
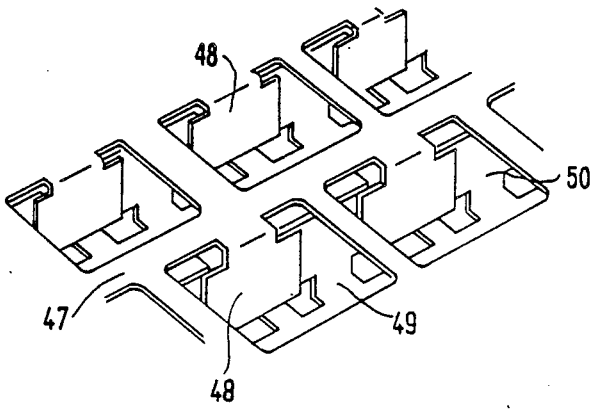
FIG. 7 is a perspective elevational view of part of an alternative fine-deflection structure.

In the plates shown in FIGS. 4, 5 and 6 the holes are arranged in a rectangular pattern. If necessary, they may alternatively be arranged in a hexagonal pattern. In that case the desired fine-deflection structure may be obtained with an adapted (hexagonal) hole structure and half a vertical pitch offset. See FIG. 7 showing an upper plate 47 with bent limbs 48 positioned opposite a lower plate 49 with bent limbs 50, offset by a distance of half the vertical pitch, i.e., the distnce between hole centers. The method of separately bending the plate portions and subsequent assembly is most appropriate in this case.

Figure 8:
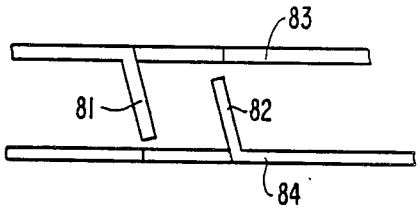
FIG. 8 shows diagrammatically a part of a cross-section of an alternative post-deflection structure.

The bent limbs need not be positioned transversely to the plane of the plates. For given designs they may be, for example, positioned obliquely to the plane of the plates (see FIG. 8), in which limbs 81 and 82 will form an electrode pair when the plates 83 and 84 are assembled.

The above-described fine deflection structures in which a pair of electrically insulated deflector plate portions or limbs bent from two plates is positioned on either side of each electron beam channel may not only be used in picture display devices of the type using a deflection system for the beam selection, as is shown in FIG. 1, but also in other types of picture display devices, particularly of the flat, thin type in which fine-deflection is required, for example in a display device as described in EP-94 6 22.

What is claimed is:

1. A picture display device comprising a closed envelope having substantially parallel front and rear walls, a layer of luminescent material on the inner surface of the front wall, electron-emissive means for generating at least one electron beam and a selection electrode system for causing the or each electron beam to be substantially perpendicularly incident on the layer of luminescent material so that the or each beam scans at least a part of the layer of luminescent material for building up a picture, and a fine-deflection structure comprising individual electron beam channels with each of which a first and a second deflector electrode is associated, which deflector electrodes can be energized to deflect an electron beam from the electron beam channel and which can be suitably controlled so that the electron beam can be accurately directed onto a desired surface element of the layer of luminescent material, characterized in that two facing sides of each individual electron beam channel are provided with electrically isolated limbs bent out of the planes of two facing metal plates and constituting deflector electrodes.

2. A picture display device as claimed in claim 1, characterized in that the limbs between the electron beam channels are mechanically coupled to form electrically insulated pairs.

3. A method of manufacturing a post-deflection structure for a picture display device, the device comprising a closed envelope having substantially parallel front and rear walls, a layer of luminescent matrial on the inner surface of the front wall, electron-emissive means for generating at least one electron beam and a selection electrode system for causing the or each electron beam to be substantially perpendicularly incident on the layer of luminescent material so that the or each beam scans at least a part of the layer of luminescent material for building up a picture, and a fine-deflection structure comprising individual electron beam channels with each of which a first and a second deflector electrode is associated, which deflector electrodes can be energized to deflect an electron beam from the electron beam channel and which can be suitably controlled so that the electron beam can be accurately directed onto a desired surface element of the layer of luminescent material, the method characterized: in that a pair of metal plates is provided, a plurality of U-shaped openings is provided in each metal plate, which openings each define a deflector electrode plate portion or limb; in that the deflector electrode limbs in each plate are bent out of the planes of the plates; and in that the plates are positioned opposite each other with respective deflector electrode limbs facing each other and being aligned with respect to each other.

4. A method of manufacturing a post-deflection structure for a picture display device, characterized: in that a pair of metal plates is provided, a plurality of U-shaped openings is provided in each metal plate, which openings each define a deflector electrode plate portion or limb on three sides; in that, after the plates have been provided with the open, an electrically insulating bonding agent is provided on the deflector electrode limbs of at least one plate; in that the plates are positioned back-to-back opposite each other in such a manner that the deflector electrode limbs of the one plate are aligned with the deflector electrode limbs of the other plate; in that the plates are secured together by means of said bonding agent; and in that the plates are subsequently moved away from each other and are simultaneously offset with respect to each other in a direction transverse to the bending lines of the deflector electrode limbs so that the deflector electrode limbs are bent pairwise out of the planes of the plates.

* * * * *